United States Patent [19]

Kocsis

[11] Patent Number: 4,672,701

[45] Date of Patent: Jun. 16, 1987

[54] POLYPROPYLENE FIBER BAFFLE FOR WATERBED MATTRESS

[75] Inventor: Andre Kocsis, Toronto, Canada

[73] Assignee: Halcyon Waterbed Inc., Downsview, Canada

[21] Appl. No.: 909,600

[22] Filed: Sep. 22, 1986

[30] Foreign Application Priority Data

Feb. 25, 1986 [CA] Canada ..... 502633

[51] Int. Cl.[4] ..... A47C 27/08; B32B 1/00; D04H 1/58

[52] U.S. Cl. ..... 5/450; 5/451; 428/74; 428/288; 428/297; 428/303; 428/401

[58] Field of Search ..... 5/450, 451; 428/74, 428/288, 297, 303, 401

[56] References Cited

U.S. PATENT DOCUMENTS

| | | | |
|---|---|---|---|
| 3,914,497 | 10/1975 | Kanehira et al. | 428/288 |
| 3,940,537 | 2/1976 | Burns | 428/288 |
| 4,086,381 | 4/1978 | Cheshire et al. | 428/288 |
| 4,168,335 | 9/1979 | Vos et al. | 428/288 |
| 4,301,560 | 11/1981 | Fraige | 5/450 |
| 4,374,894 | 2/1983 | Antlfinger | 428/288 |
| 4,481,248 | 11/1984 | Fraige | 428/283 |
| 4,496,623 | 1/1985 | Fraige | 428/283 |
| 4,607,404 | 8/1986 | Fraige | 5/450 |

*Primary Examiner*—William J. Van Balen

*Attorney, Agent, or Firm*—Riches, McKenzie & Herbert

[57] ABSTRACT

In a waterbed mattress a novel wave dampening batt of unwoven polypropylene fibers bonded together with an ethylene acrylic acid binder so as to provide the resultant batt with a specific gravity in the range of 0.9 to 0.999. Polyester fibers may advantageously be mixed with the polypropylene fibers.

25 Claims, 4 Drawing Figures

POLYPROPYLENE FIBER BAFFLE FOR WATERBED MATTRESS

SCOPE OF THE INVENTION

This invention relates to waterbeds and more particularly to a novel floating batt manufactured from polypropylene fibers to be received in a waterbed to dampen wave motion.

BACKGROUND OF THE INVENTION

In the past non-woven polyester fiber devices have been placed inside waterbed mattresses to dampen wave motion therein. Such non-woven polyester fiber products suffer the disadvantage that the fiber products have a specific gravity greater than 1.0 and sink in water. For advantageous use of such fiber products, floatation devices such as closed cell foams are used to float the composite structure. The floatation devices typically have reduced the extent to which the overall batt can be compressed for shipment in a minimum of space, have increased the overall mass of the wave damping device, and have generally complicated the process of manufacturing the wave damping devices. Moreover, use of closed cell foam floatation devices have made the waterbed mattresses less comfortable to sleep on in that stiff foam can be felt through the mattress.

SUMMARY OF THE INVENTION

Accordingly it is an object to at least partially overcome these disadvantages of the prior art by providing a wave damping batt made from unwoven polypropylene fibers bonded together with a binder wherein the resultant batt has a specific gravity in the range of 0.9 to 0.999.

Another object is to provide a batt incorporating unwoven polypropylene fibers bonded together with a binder which batt has loft and is substantially elastically deformable.

Another object is to provide a floating batt of polypropylene fibers bonded together under low temperature conditions so as to maintain the resiliency and loft of the polypropylene fibers.

Accordingly in one of its aspects the present invention provides, in a waterbed mattress comprising a water inflatable bag-like member and wave dampening means in said member, the improvement wherein said wave dampening means comprises a resiliently deformable fiber product of unwoven fibers bonded together with a binder, the fiber product having a specific gravity in the range of 0.9 to 0.999, the unwoven fibers comprising polypropylene fiber, preferably with a denier number of at least 40.

In another aspect, the present invention provides a wave dampening device for a waterbed comprising a unitary substantially elastically deformable batt with loft, the batt comprising unwoven fibers bonded together with a binder which can be cured at temperatures below about 215° F., the batt having about 1 to 2 ounces of unwoven fiber per square foot surface area of the batt, a specific gravity of between 0.94 and 0.999 and comprising 60 to 90% by weight unwoven fiber and 10 to 40% by weight binder, the unwoven fiber comprising 60 to 100% by weight polypropylene fiber with a denier number of at least 40 in which at least 70% by weight of the polypropylene fiber has a denier number of at least 60, the unwoven fiber further comprising 0 to 40% by weight polyester with a denier number of at least 40.

In a further aspect, the present invention provides for use with a waterbed mattress for damping wave action in the mattress, a damping structure having a specific gravity in the range of 0.94 to 0.999, extending under a substantial portion of the undersurface of a top sheet of the waterbed matress in contact therewith and consisting of a unitary resiliently deformable batt with loft, comprising unwoven fibers bonded together with a binder, the batt comprising 60 to 85% by weight unwoven fiber and 15 to 40% weight binder, the unwoven fibers comprising 60 to 100% by weight polypropylene fiber with the balance polyester fiber, the polypropylene fiber having a denier number of at least 40 with at least 70% by weight of the polypropylene fiber having a denier number of at least 60, said unwoven fibers bonded together with said binder at temperatures not exceeding 220° F.

BRIEF DESCRIPTION OF THE DRAWINGS

Further objects and advantages will appear from the following description taken together with the accompanying drawings in which.

DETAILED DESCRIPTION OF THE DRAWINGS

Figure 1:
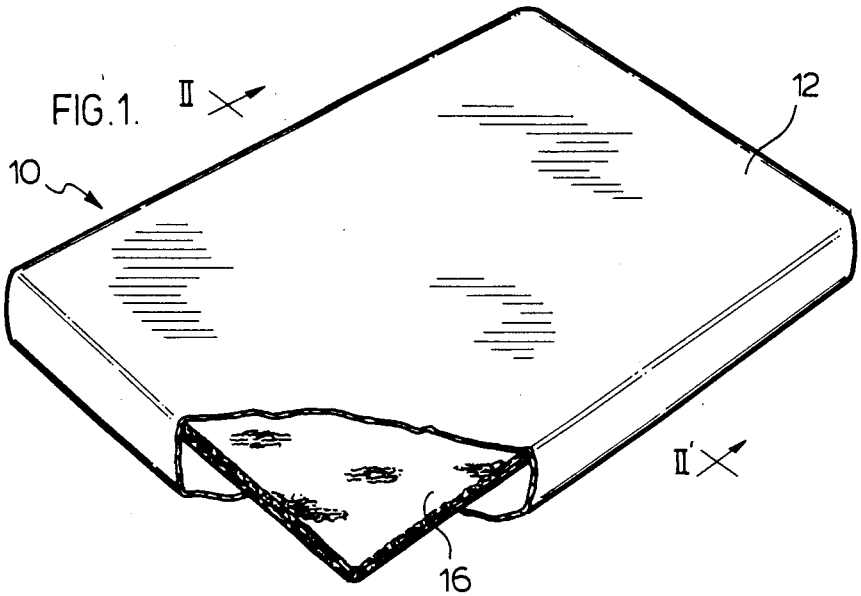
FIG. 1 is a pictorial view of a waterbed mattress with one corner of the outer cover removed to show a first preferred embodiment of a wave damping device in accordance with the present invention.
Figure 2:
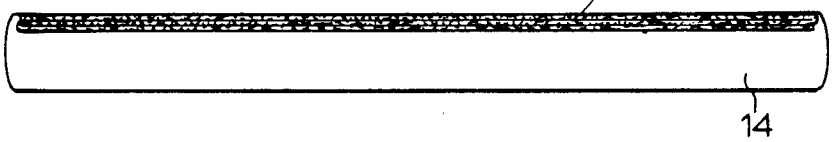
FIG. 2 is a cross-sectional view taken along line II—II' of FIG. 1.
Figure 3:
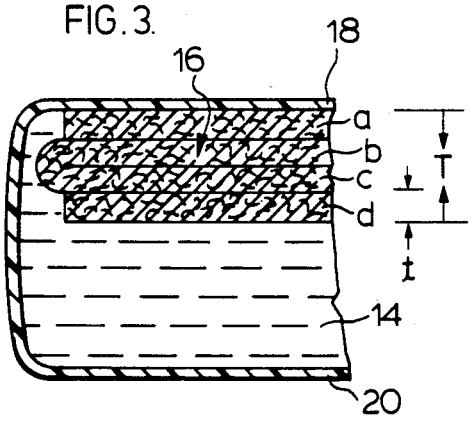
FIG. 3 is an enlarged view of FIG. 2.

Reference is made first to FIG. 1 which shows a waterbed mattress generally designated 10 comprising a collapsible and inflatable bag-like cover 12 to receive water 14 therein. Disposed within cover 12 is a wave damping device comprising a batt of non-woven fibers bonded together with a binder. Batt 16 has a density marginally less than that of water. Accordingly as best seen in FIG. 3, batt 16 floats in water 14 with upper surfaces of batt 16 in close contact with the undersurface of top sheet 18 of cover 12. Batt 16 as shown comprises a number of layers a, b, c, d of a continuous unitary length of batting folded at each end so as to extend back over itself. In this manner a resultant batt 16 is provided with a desired thickness "T" (height) from a plurality of layers of lesser thickness "t". Preferably the individual layers are sewn together to from a unitary batt 16.

Batt 16 extends under a substantial portion of the undersurface of top sheet 18 and has a thickness less than the height between top sheet 18 and bottom sheet 20 of the mattress.

Advantageous wave damping is provided with batt 16 floating upwardly to be located immediately below under surface of top sheet 18. To provide such floatation, batt 16 is made from unwoven fibers and binders in proportions chosen so that the batt may have a specific gravity in the range of 0.9 to 0.999, preferably in the range of 0.950 to 0.999. If the specific gravity is much below 0.9, the buoyance is too high and a sleeper may feel the batt through top sheet 18.

Moreover, by making the specific gravity close to that of water, a mechanical coupling is achieved between the water and the batt. The batt reduces wave motion by the inertia of the batt resisting water movement. By having a specific gravity close to that of water, there is good coupling between water and the batt because the batt, which cannot move substantially inside the mattress, absorbs energy and damps the waves. The closer the specific gravity of the batt to that of water, the better the mechanical coupling and the better the damping. To maximize mechanical coupling to water, it is preferred that the composite bonded fiber in the batt have a specific density as close as possible to 1.0.

Advantageously the batt covers as much of the surface area of the mattress as practical. If the batt is smaller, it can move around and the water's kinetic energy is transformed into kinetic energy of the batt. With the batt underlying substantially the entirety of the underside of top sheet 18, there is no room for movement and it can not develop kinetic energy.

Figure 4:
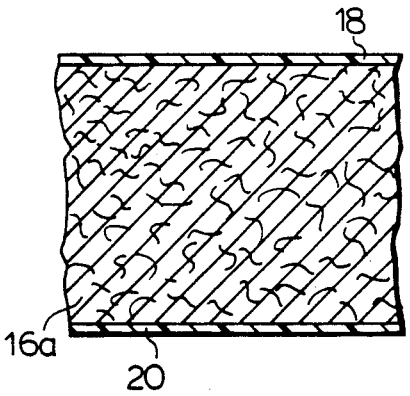
FIG. 4 is a view similar to FIG. 3 of a second preferred embodiment of a wave damping device in accordance with the present invention.

In the second embodiment illustrated in FIG. 4, batt 16*a* is shown to extend the full distance between top cover 18 and bottom cover 20 to minimize the ability of batt 16 to move: With batt 16*a* having a specific gravity less than water, the batt is ensured to remain in contact with top sheet 18.

The present invention appreciates that polypropylene fibers may advantageously be used in producing a batt which will float. Polypropylene fibers are hydrophillic and have a specific gravity in the range of about 0.910. Advantageous batts may consist of polypropylene fibers alone bonded with a suitable binder or mixtures of polypropylene fibers and other fibers, particularly polyester bonded with a binder. Polyester fibers typically have a specific gravity in the range of about 1.384.

By the selection of binders having suitable specific gravities and use of desired proportions of of binder to polypropylene, batts can be produced having desired specific gravities in the range of 0.90 to 0.999. For example, the binder may typically comprise 15 to 40% by weight of the resultant batt, preferably 20 to 35% by weight. In a batt containing 20% by weight binder and the remainder polypropylene fibers, the binder may have a specific gravity in the range of 0.86 to less than 1.36 to produce a resultant batt with a specific gravity between 0.90 and less than 1.0. In a batt containing 40% by weight binder and the remainder polypropylene fibers, the binder may have a specific gravity in the range of 0.885 to less than 1.134 to produce a resultant batt with a specific gravity between 0.90 and less than 1.0.

The batt may advantageously comprise unwoven fibers consisting of a mixture of polypropylene fibers and other fibers all bonded together with a binder. In this case by the selection of desired proportions of polypropylene fibers to the other fibers and by the selection of suitable proportions of binder to the total unwoven fiber having regard to the specific gravity of each material, the resultant batt may have a specific gravity in the desired range of 0.90 to 0.999.

Batts in accordance with the present invention are preferably resistant to compression yet sufficiently resilient to prevent a person using the mattress from feeling the batt through top sheet 18. The batt preferably has loft, loft being an expression used in the art to describe fiber products with a thickness that is resilient and resists compression. Ideally the batts would be elastically deformable and always return to an initial size after compression.

Waterbed mattresses are shipped in a collapsed state with the dampening batt compressed therein. The batt is preferably substantially elastically deformable so that even after being compressed for an extended period of time, the fibers will not remain bunched up but will expand to approximately their initial uncompressed configuration.

The present inventor has found that batts of polypropylene fiber have improved resiliency and loft if polypropylene fibers with larger denier numbers are used, preferably having denier numbers of at least 40 and more preferably of at least 60. Polypropylene fibers with denier number of 130 and larger are useful. As well batts may comprise mixtures of polypropylene fibers of different denier numbers.

The conditions of manufacture of the batt have an effect on the resiliency and loft of the resultant batt. If subjected to high temperatures, polypropylene fiber will collapse. The resiliency and loft of batts produced from polypropylene fibers have been found to decrease as the batt is subjected to increasingly high temperatures during the bonding process. The resiliency and loft of a polypropylene batt may advantageously be increased by bonding the unwoven fibers with a binder at lower temperatures, preferably below 220° F. or below 185° F. Preferably therefore binders acceptable for bonding the unwoven fibers are chosen which cure at such lower temperatures.

In regard to the choice of binder and other fibers for use with polypropylene, it is to be appreciated that the resultant batt must not deteriorate or break down in water nor under bacterial attack. The batt must not break down in use. The binder must bond fibers together with bonds of sufficient strength to not fail under conditions of normal use. The materials for the batt should also be relatively inexpensive.

Preferred binders for use with unwoven fibers consisting of polypropylene fiber or mixtures of polypropylene fiber and polyester fiber are ethylene acrylic acid copolymers such as those introduced by Dow Chemical Company under the trade name DOW EAA Dispersion No. 490 and now sold as one of a number of dispersions under the trade mark PRIMACOR, preferably PRIMACOR polymer dispersion 4990 (corresponding to EEA Dispersion No. 490) and PRIMACOR polymer dispersion 4983. PRIMACOR Dispersion 4990 is an aqueous colloidal dispersion of an ethylene/acrylic acid copolymer which is partially neutralized with ammonia. The dispersion is described in a publication of DOW Chemical Company entitled DOW EEA Dispersion 490 and in DOW FORM NO. 305-1168-284. Use of PRIMACOR Dispersion 4990 with non-wovens is described in a 1984 publication of Dow Chemical Company entitled "PRIMACOR Polymer Dispersion 4990 For Resin-Bonding Non-Wovens". With ethylene acrylic acid copolymers having a large number of unneutralized carbonyl groups, there is excellent adhesion to polypropylene and polyester.

As with PRIMACOR Dispersion 4990, the ethylene acrylic acid copolymers are preferably applied as a colloidal dispersion in a volatile solvent and cured by a drying process with drying capable of being carried out at relatively low temperatures, for example in the range of 210° F. to 180° F. and lower. Preferred binders such as PRIMACOR Dispersion 4990 are water insoluble when cured.

The specific gravity of ethylene acrylic acid copolymers may be less than 1.0, for example in the case of PRIMACOR Dispersion 4990 about 0.960. With PRIMACOR Dispersion 4990 having a specific gravity of 0.960 and polypropylene having a specific gravity of 0.91, any mixture of this binder with polypropylene fiber alone will produce a specific gravity within the desired range of 0.90 to 0.999 for a batt. That the PRIMACOR Dispersion 4990 has a specific gravity less than 1.0, assists in permitting the addition of additional quantities of fibers such as polyester with specific gravities above 1.0 yet retain the overall specific gravity of the batt below 1.0.

While binders with specific gravity below 1.0 are preferred, binders with specific gravities above 1.0 have the advantage of permitting the use of additional quantities of polypropylene fiber.

Preferred batts in accordance with the present invention have an unwoven fiber mixture of 0 to 30% by weight polyester fibers with the remainder polypropylene. Such unwoven fiber mixtures may advantageously be used in batts containing 20 to 40% by weight of a binder such ethylene acrylic acid copolymers, preferably 21 to 32%.

A preferred batt in accordance with the present invention was made from an unwoven fiber mixture of 90% polypropylene fibers and 10% polyester fibers. If PRIMACOR Dispersion 4990 is used as the binder, then if the binder comprises 20% by weight of the resultant batt, the batt has a specific gravity of 0.950. If the binder comprises 32% by weight of the resultant batt, the batt has a specific gravity of 0.968.

Preferred batts have been manufactured using PRIMACOR Dispersion 4990 as the binder for unwoven fiber comprising either pure polypropylene fiber or polypropylene fiber and polyester fiber. A surfactant such as Triton (trade mark) GRS-M made by Rohm & Haas Company Ltd. may be used to assist in wetting of the fibers by the dispersion. Defoamers such as hexanol may be added if the binder develops a foam. A preferred binder formulation is set out in Table 1 below.

TABLE 1

| | BINDER FORMULATION | | |
|---|---|---|---|
| PRODUCT | % SOLIDS | BATCH WT (LBS) | DRY WT (LBS) |
| PRIMACOR 4990 | 35 | 860 | 301 |
| TRITON GR-5M | 60 | 20 | 12 |
| HEXANOL | — | 2 | 2 |
| WATER | — | 693 | — |
| TOTAL | 20 | 1575 | 315 |

After coating the unwoven fibers, the dispersion may be air dried by passage of air heated to temperatures between 185° and 210° F. Air drying at lower temperatures is enhanced by making the batts relatively thin in thickness. Measured in respect of the weight of one layer of the final cured batt per square foot of its major surface area, operation to produce a concentration of 1 ounce of batt per square foot permits for improved air drying at lower temperatures than with concentration of 2 ounces of batt per square foot. Concentration of 0.5 to 2.0 ounces per square foot are preferred. Concentrations in the range of 0.5 to 2.0 ounces per square foot are also preferred where the binder formulation is to be sprayed onto the batt. Increased concentrations may be acceptable, if the batt is to be dipped in the binder formulation.

While the invention has been described with particular reference to PRIMACOR Dispersion 4990 as a preferred ethylene acrylic binder, other binders may be used. PRIMACOR Dispersion 4990 is relatively expensive and mixtures of binders for polypropylene plus other less expensive binders suitable for polyester may be used. While polyester is a preferred fiber for mixture with polypropylene, many other unwoven fibers may be suitable including the following:

| Fiber | Specific Gravity |
|---|---|
| Polyethylene | 0.96 |
| Nylon | 1.14 |
| Acetate | 1.32 |
| Acrylic | 1.40 |
| Rayon | 1.54 |
| Vinylon | 1.60 |
| Carbon/Graphite | 2.0 |
| Fluorocarbon | 2.3 |

Fiber mixtures may suitably be selected having regard to the specific gravity, resiliency and loft of the resultant batt and suitable binders therefore.

A preferred process for manufacture of the batts comprises crimping fibers of a length of about three inches into a saw-tooth configuration then randomly dropping the crimpled fibers onto a moving conveyor belt-like scrim. The dropped fibers become entangled and take up a random orientation producing an unbonded batt. The crimped fibers do not lie flat but become entangled to provide loft (height) to the batt. The binder formulation may subsequently be sprayed onto the fibers and tends to gather in droplets where the fibers touch each other. During curing the droplets harden and the relative positions of the fibers become fixed. If desired, prior to spraying with the binder formulation, the batt of crimped fibers may be partially compacted to reduce the initial height of the batt as by vibration or passing the batt on the moving scrim under a roller.

Table 2 sets out four examples of batts produced in accordance with the present invention. In each of the examples the binder was added as a binder formulation as set out in FIG. 1 and the batts were air dried at a temperature of 200° F. The fiber blends for each example are shown in the table. The binder content is shown as weight percent of binder in the resultant cured batt. The weight of the cured batt is shown as the weight in ounces of the batt per square foot of its major surface area. In each of the examples, after dropping crimped fibers of about three inch length onto a moving screen, the unbounded batt was passed under a roller. The loft (height) of the batt was measured before the roller, after the roller, after spraying with the binder information and after final curing. Examples 3 and 4 were carried out with the scrim moving at lower speeds to provide increased weight to the batt and accordingly increased loft.

TABLE 2

| Example | 1 | 2 | 3 | 4 |
|---|---|---|---|---|
| Fiber Composition | | | | |
| Polypropylene | 100% 60 den | 80-90% 60 den | 80-90% 60 den | 80-90% 130 den |
| Polyester | | 10-20% 40 den | 10-20% 40 den | 10-20% 40 den |
| Binder | 25% | 25% | 27% | 22% |

TABLE 2-continued

| Example | 1 | 2 | 3 | 4 |
|---|---|---|---|---|
| Content Weight (oz/sq. ft) | 1.4 | 1.4 | 1.65 | 2.0 |
| Loft: inches | | | | |
| before roller | 7 | 7–7½ | 8 | 7½ |
| after roller | 4 | 4½ | 4½ | 4½ |
| after spray | 3 | 3 | 3½ | 3½ |
| after curing | 1½–1¾ | 1½–1¾ | 2½ | 2¼–2½ |
| Estimated Specific Gravity of Cured Batt | .92 | .98 | .97 | .97 |

Comparable weight batts of each of Examples 1 to 4 were tested in a waterbed mattress to measure their damping ability. Each perfomed well.

Additional exemplary batts were produced using the binder formulation as set out in Table 1 in varying proportions with unwoven fiber compositions A to D as set out in Table 3. Comparable weight batts made from each composition were tested in a mattress to measure their damping ability. Preferred results were obtained with the cured batt having binder content of 20 to 30 percent by weight of the cured batt when curing at temperatures between about 210° F. and 180° F. with batt weight of about one ounce per square foot batt. Generally compositions C and D provided the best results.

TABLE 3

| COMPOSITION | UNWOVEN FIBER COMPOSITION % BY WT. | UNWOVEN FIBER SPECIFIC GRAVITY |
|---|---|---|
| A | 85% 60 Denier polypropylene<br>15% 40 Denier polyester | 0.98 |
| B | 100% 60 Denier polypropylene | 0.91 |
| C | 80% 60 Denier polypropylene<br>20% 130 Denier polypropylene | 0.91 |
| D | 90% 60 Denier polypropylene<br>10% 40 Denier polyester | 0.95 |

In accordance with the present invention, batts may preferably be made from unwoven fibers, whether of polypropylene, polyester or other materials, having a denier number of at least 40 to provide advantageous body, shape vention and loft. Unwoven fibers of lesser thickness such as as low as 15 denier and lower may be used, but are not preferred.

While the invention has been described with reference to preferred embodiments, it is not so limited. Many variations and modifications will now occur to those skilled in the art. For a definition of the invention, reference is made to the following claims.

What I claim is:

1. In a waterbed mattress comprising a water inflatable bag-like member and wave dampening means in said member, the improvement wherein said wave dampening means comprises a resiliently deformable bonded fiber product of unwoven fibers bonded together with a binder, the fiber product having a specific gravity in the range of 0.9 to 0.999, the unwoven fibers comprising polypropylene fiber.

2. The improvement of claim 1 wherein said polypropylene fibers have a denier number of at least 40.

3. The improvement of claim 1 wherein said unwoven fibers further comprise polyester fibers.

4. The improvement of claim 1 wherein said binder has a specific gravity less than 1.

5. The improvement of claim 1 wherein said binder has a specific gravity greater than 1.

6. The improvement of claim 1 wherein the fiber product comprises:

60 to 85% by weight unwoven fibers, and 15 to 40% by weight binder.

7. The improvement of claim 6 wherein the unwoven fiber consists essentially of:

60 to 100% by weight polypropylene fiber, and 0 to 40% by weight polyester fiber.

8. The improvement of claim 7 wherein the binder has a specific gravity less than 1.

9. The improvement of claim 8 wherein the binder comprises at least partially unneutralized ethylene acrylic acid copolymers.

10. The improvement of claim 9 wherein said unwoven fiber product is bonded with said binder by curing of the binder at temperatures less than 220° F.

11. The improvement of claim 9 wherein said unwoven fiber product is bonded with said binder by curing of the binder at temperatures less than 190° F.

12. The improvement of claim 11 wherein the polypropylene fiber has a denier number of at least 40 and the polyester fiber a denier number of at least 40.

13. The improvement of claim 9 wherein said product is produced by a process comprising applying the binder to the unwoven fiber as a dispersion of the binder in a volatile solution, and air drying the dispersion at temperatures not exceeding 220° F.

14. The improvement of claim 1 wherein said unwoven fiber product is bonded with said binder by curing of the binder at temperatures less than 220° F.

15. The improvement of claim 7 wherein said polypropylene fibers have denier numbers not less than 40.

16. The improvement of claim 15 wherein at least 70% by weight of said polypropylene fiber has a denier number of 60 or greater.

17. The improvement of claim 16 wherein said polyester fibers have a denier number of at least 40.

18. The improvement of claim 17 wherein said product comprises a plurality of layers of a resiliently deformable batt with loft stacked one upon the other with each layer having a concentration of about 1 to 2 ounces per square foot.

19. The improvement of claim 1 wherein said binder is curable at temperatures below about 215° F.

20. A wave dampening device for a waterbed comprising a unitary substantially elastically deformable batt with loft, the batt comprising unwoven fibers bonded together with a binder which can be cured at temperatures below about 220° F., the batt having about 1 to 2 ounces of unwoven fiber per square foot surface area of the batt, a specific gravity of between 0.94 and 0.999, and comprising 60 to 90% by weight unwoven fiber and 10 to 40% by weight binder, the unwoven fiber comprising 60 to 100% by weight polypropylene fiber with a denier number of at least 40 in which at least 70% by weight of the polypropylene fiber has a denier number of at least 60, the unwoven fiber further comprising 0 to 40% by weight polyester with a denier number of at least 40.

21. For use with a waterbed mattress for dampening wave action in the mattress, a damping structure having a specific gravity in the range of 0.94 to 0.999, extending under a substantial portion of the undersurface of a top sheet of the waterbed mattress in contact therewith and consisting of a unitary resiliently deformable batt with loft comprising unwoven fibers bonded together with a binder, the batt comprising 60 to 85% by weight unwoven fiber and 15 to 40% weight binder, the unwoven fibers comprising 60 to 100% by weight polypropylene fiber with the balance polyester fiber, the polypropylene fiber having a denier number of at least 40 with at least 70% by weight of the polypropylene fiber having a denier number of at least 60, said unwoven fibers bonded together with said binder at temperatures not exceeding 220° F.

22. The improvement of claim 1 wherein said polypropylene fibers have a denier number of at least 40.

23. The improvement of claim 2 wherein said polypropylene fibers have a denier number of at least 40 and said polyester fibers have a denier number of at least 40.

24. The improvement of claim 3 wherein said polypropylene fibers have a denier number of at least 40 and said polyester fibers have a denier number of at least 40.

25. The improvement of claim 2 wherein said fiber product has a specific gravity of between 0.95 and 0.999.

* * * * *